US006394384B1

(12) United States Patent
Alday et al.

(10) Patent No.: US 6,394,384 B1
(45) Date of Patent: May 28, 2002

(54) MULTI-ROLL MEDIA SUPPORTING AND SUPPLY SYSTEM

(75) Inventors: James M. Alday, Honeoye Falls; David A. Bartman, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 13 days.

(21) Appl. No.: 09/656,347

(22) Filed: Sep. 6, 2000

(51) Int. Cl.[7] ..... B65H 19/12; B65H 20/02

(52) U.S. Cl. ..... 242/559.2; 242/564.4; 242/566

(58) Field of Search ..... 242/559.2, 564.4, 242/566

(56) References Cited

U.S. PATENT DOCUMENTS 1,449,093 A * 3/1923 Finley ..... 242/559.2
2,703,681 A * 3/1955 Jacobs ..... 242/559.2
3,276,712 A * 10/1966 Walker ..... 242/559.2
3,567,151 A * 3/1971 Williams ..... 242/559.2
4,743,335 A * 5/1988 Krappitz et al. ..... 242/559.2
4,875,611 A 10/1989 Poehlein et al. ..... 226/186
4,948,060 A * 8/1990 Kurz et al. ..... 242/559.2
5,036,359 A * 7/1991 Duijve et al. ..... 242/559.2
5,060,877 A * 10/1991 Bullivant ..... 242/566
5,823,083 A * 10/1998 Obertegger et al. ..... 242/559.2
5,850,984 A * 12/1998 Kleitz ..... 242/559.2

* cited by examiner

*Primary Examiner*—John M. Jillions
(74) *Attorney, Agent, or Firm*—Tallam I. Nguti

(57) ABSTRACT

A multi-roll media supporting and supply system is provided for supporting and supplying a web of media from a roll of media to a media using machine. The multi-roll media supporting and supply system includes a support mechanism having a first side and a second side; a media supply assembly supported rotatably on the support mechanism, including a cylindrical member having a circular periphery, a shaft defining a first axis of rotation, and a plurality of elongate recesses for each supporting a roll of media. The multi-roll media supporting and supply system also includes a staging assembly associated with at least one of the first side and the second side of the support mechanism for assisting loading of a roll of media onto the media supply assembly.

17 Claims, 4 Drawing Sheets

MULTI-ROLL MEDIA SUPPORTING AND SUPPLY SYSTEM

BACKGROUND OF THE INVENTION

This invention relates to media roll supply assemblies, and more particularly, to an economical and versatile multi-roll media supporting and supply system that enables any one of a plurality of rolls supported thereon to be economically and easily fed to a roll using machine such as to a printer/copier or plotter.

Printers and plotters which use image recording media and are capable of producing copies of large documents such as engineering drawings, blueprints and the like, are of course well known. As disclosed for example in U.S. Pat. No. 4,875,611, the image recording media, typically paper, is commonly supplied in the form of a heavy roll that is wound about an inner core. The roll as such must be stored, and later supported and supported (by some type of a roll supporting and supply system) in an axial position so that the paper can be easily unrolled in a generally flat condition and then fed into a media or paper path of the particular machine using it.

Some media roll using machines such as wide format copiers use three rolls of media, arranged conventionally in a vertical, or near vertical array. This results in a higher machine than desired, as well as in various lengths of media between the roll and the next stage of the process, usually a cutter. Consequently, there is a need to significantly rewind the media web from a feeding roll, if it is desired to remove it for any reason, or if it is the end of a roll. Such conventional roll media supporting assemblies typically: are loadable only from one side, have a relatively large footprint; require significant downtime for rewinding in order to switch rolls; and require remote or difficult storage of roll or rolls needed next for loading. Such a roll media supporting and supply system is thus not economical or easy to use.

There is therefore a need for a roll media supporting and supply system that: is loadable from more than one side, has a relatively small footprint; requires little or no downtime for rewinding in order to switch rolls; and requires no remote or difficult storage of roll or rolls needed next for loading. In addition, there is a need for a roll media supporting and supply system that: is loadable while also feeding.

SUMMARY OF THE INVENTION

In accordance with the present invention, there is provided a multi-roll media supporting and supply system for supporting and supplying a web of media from a roll of media to a media using machine. The multi-roll media supporting and supply system includes a support mechanism having a first side and a second side; a media supply assembly supported rotatably on the support mechanism, including a cylindrical member having a circular periphery, a shaft defining a first axis of rotation, and a plurality of elongate recesses, each for supporting a roll of media. The multi-roll media supporting and supply system also includes a staging assembly associated with at least one of the first side and the second side of the support mechanism for assisting loading of a roll of media onto the media supply assembly.

BRIEF DESCRIPTION OF THE DRAWINGS

In the detailed description of the invention presented below, reference is made to the drawings, in which.

DETAIL DESCRIPTION OF THE INVENTION

Figure 1:
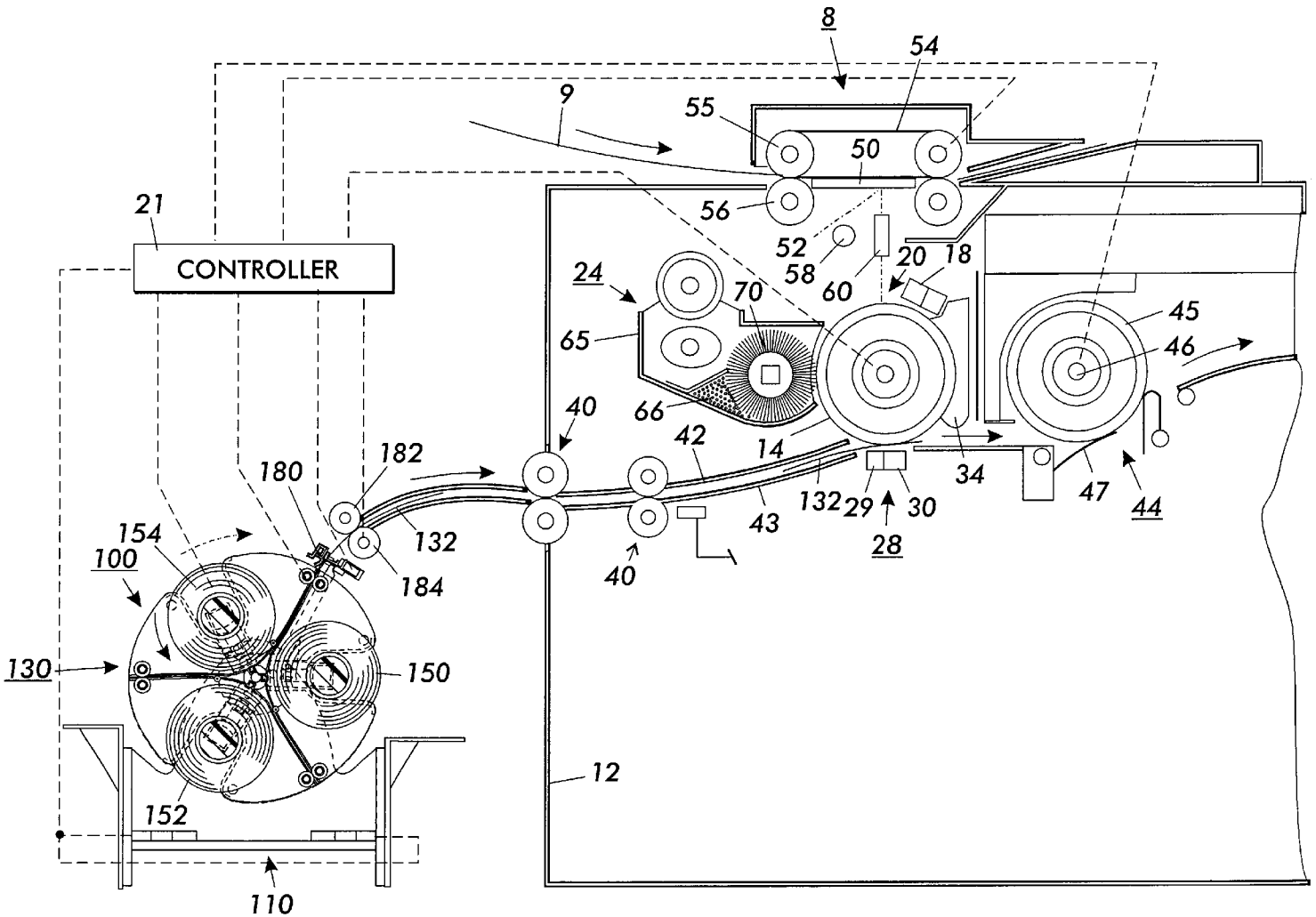
FIG. 1 is a vertical schematic of a roll media using machine, for example a xerographic reproduction machine, including the multi-roll media supporting and supply system of the present invention.

Referring first to FIG. 1, there is shown a xerographic type reproduction machine shown generally as 8, and incorporating the multi-roll media supporting and supply system of the present invention. Machine 8 has a suitable frame 12 on which the machine xerographic components are operatively supported. Briefly, and as will be familiar to those skilled in the art, the machine xerographic components include a image bearing member, or photoreceptor shown here in the form of a rotatable drum 14 having a photoconductive surface. Other types of image bearing members or photoreceptors, such as a belt or web may be used instead.

Operatively disposed about the periphery of drum 14 is charge corotron 18 for placing a uniform charge on the photoconductive surface of drum 14; an exposure station 20 where the previously charged photoconductive surface is exposed to image rays of the document 9 being reproduced; development station 24 where the latent electrostatic image created on the photoconductive surface is developed by toner; transfer station 28 with transfer corotron 29 and detack corotron 30, for transferring the developed image to a portion of the media web 132 supplied from the multi-roll media supporting and supply system 100 of the present invention, in timed relation with the developed image on the photoreceptor surface. A cleaning station 34 is also provided for removing leftover developer material from the surface of the photoreceptor.

Copy media web 132, which, in a preferred embodiment is paper, is fed from multi-roll media supporting and supply system 100, and is brought forward by forwarding rolls 182, 184, feed roll assembly 40, and then fed between sheet guides 42, 43 to the image transfer station of the machine 8.

Following image transfer, the portion of copy media web 132 is carried forward to a fusing station 44 where the toner image is fixed by fusing roll 45 in cooperation for example with a biased flexible web 47. Fusing roll 45 is heated by a suitable heater such as lamp 46 disposed within the interior of roll 45. After fixing, the media 132 is conveyed to a separate output station (not shown) where the media may be further cut into appropriate smaller sized image frames or, if desired, then rolled into a cylindrical form for easier handling.

Continuing with the description of machine 8, transparent platen 50 supports original image document 9 as the document 9 is moved past a scan point 52 by a constant velocity transport 54. As will be understood, scan point 52 is, in effect, a scan line extending across the width of platen 50 at a desired point where the document is scanned line-by-line under the control of an electronic control subsystem (ESS) or controller 21 as shown. Transport 54 has input and output document feed roll pairs 55, 56, respectively, on each side of scan point 52 for moving the document 9 across platen 50 at a predetermined speed. Exposure lamp 58 is provided to illuminate a strip-like area of document 9 at scan point 52. The image rays from the document line scanned are transmitted by a gradient index lens array 60 to exposure station 20 to expose the photoreceptor surface of the moving photoreceptor drum 14. The ESS or controller 21 is preferably a self-contained, dedicated minicomputer having a central processor unit (CPU), electronic storage, and a display or user interface (UI). The ESS 21 as such is the control system which with the help of sensors and connectors, as well as, a dedicated processor or controller, can read, capture, prepare and manage information for operating and controlling all printing operations as well as the operation of the multi-roll media supporting and supply system of the present invention (to be described below).

Developing station 24 includes a developer housing 65, the lower part of which forms a sump 66 for holding a quantity of developer. A rotatable magnetic brush developer roll 70 is disposed in predetermined operative relation to the photoconductive surface. In developer housing 65, roll 70 serves to bring developer from sump 66 into developing relation with drum 14 to develop the latent images formed on the surface thereof into toner images that are then transferred with the aid of transfer device 29 onto the recording media 132 as described above.

Referring now to FIGS. 1–4, details of the multi-roll media supporting and supply system 100 will now be described. As shown, the multi-roll media supporting and supply system 100 includes a support mechanism 110 that has a first side S1 and a second side S2 from which to access the system 100. The multi-roll media supporting and supply system 100 also includes a media supply assembly 130 that is supported rotatably on the support mechanism 110. The media supply assembly 130 is supported thus for bidirectional (arrow 137) rotation on the support mechanism 110.

The media supply assembly 130 as shown, includes a cylindrical member 134 having a circular periphery 136, a drive or support shaft 140 that is or defines a first axis 140 of rotation. The media supply assembly 130 also includes a plural number of elongate recesses 142, 144, 146 which can each support a roll 150, 152, 154 of media such as paper. Although the plural number is shown as three, it is understood that the number of recesses and hence of rolls can be any suitable and desired number depending on the size of the system 100, and of each roll of media. The three elongate recesses 142, 144, 146 are arranged in a circular array, and each elongate recess has a center C1, C2, C3 spaced 120° from that of an adjacent elongate recess. The base of each elongate recess 142, 144, 146 has the same depth or is spaced an equal distance from the periphery 136 towards the axis 140 of rotation of the cylindrical member 134.

The multi-roll media supporting and supply system 100 further includes staging means 160, 162 associated with at least one of the first side S1 and the second side S2 of the support mechanism 110, for assisting loading (FIGS. 3, 4) of a roll 150, 152, 154 of media into an empty elongate recess 142, 144, 146 within the media supply assembly 130. Each elongate recess 142, 144, 146 has a latching mechanism 151 for retaining a roll 150, 152, 154 of media loaded therein. Latching mechanism 151 for example can be actuated by a cam (not shown) that closes and opens automatically, thus requiring no manual prying or depressing to open or close it.

Figure 3:
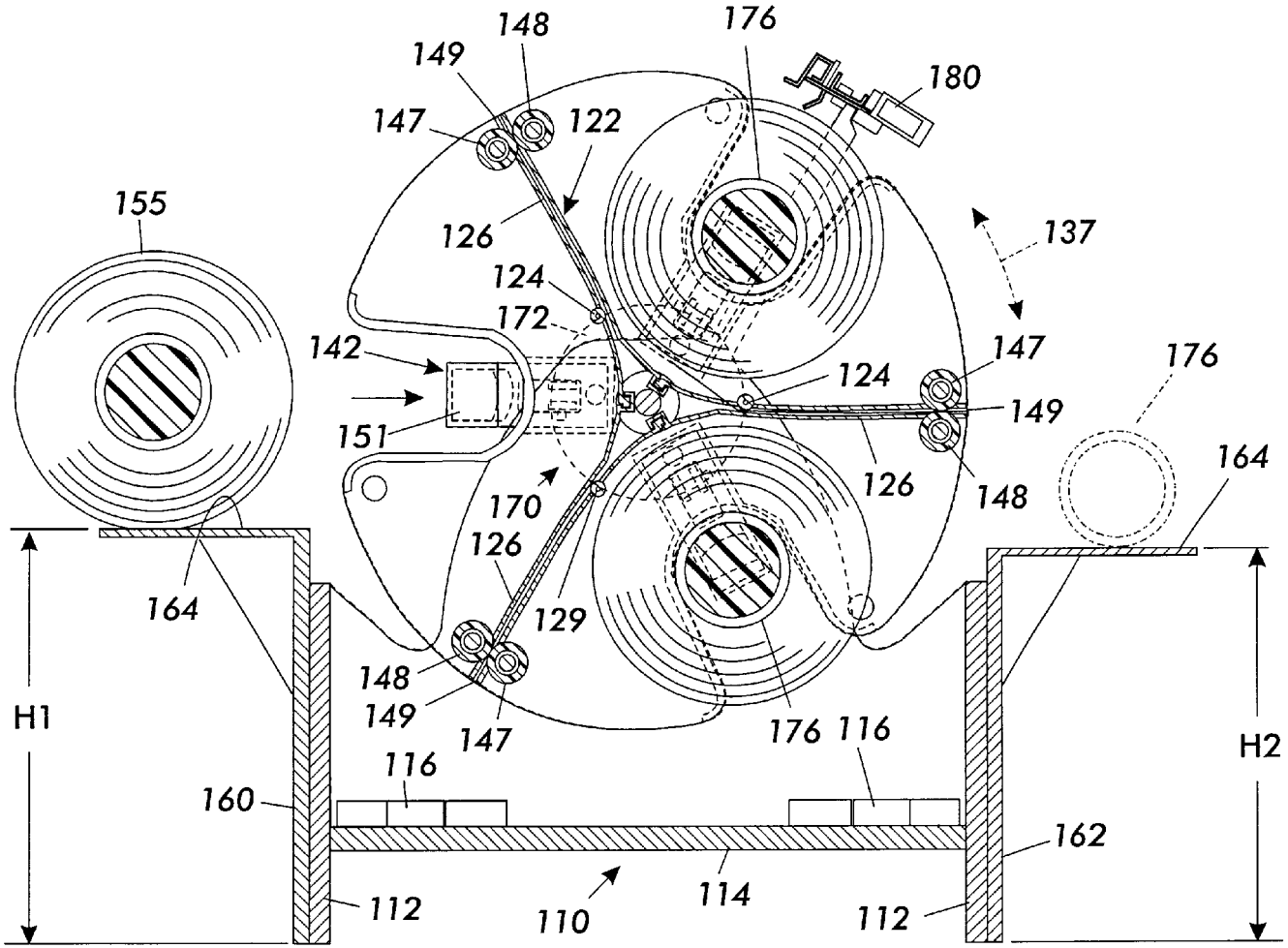
FIG. 3 is the schematic of FIG. 2 with a roll staged in a first loading position.
Figure 4:
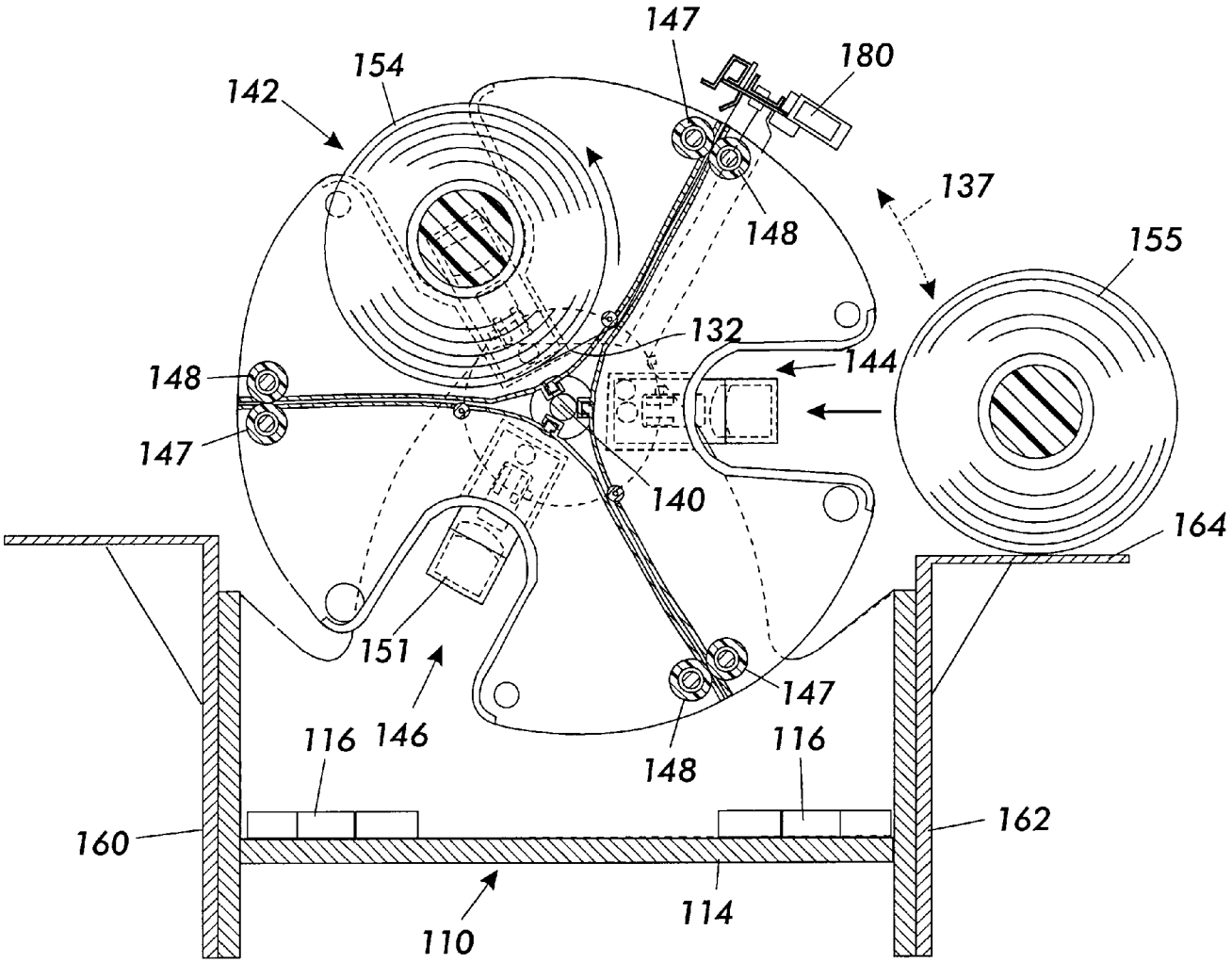
FIG. 4 is the schematic of FIG. 2 with a roll staged in a second loading position while another roll is web feeding in accordance with the present invention.

As shown, the support mechanism 110 includes a set of legs 112, and cross members 114 (one of which may be horizontal) for holding electronic control components 116 for the multi-roll media supporting and supply system 100. A pair of staging means 160, 162 one for each of the first side S1 and the second side S2 of the support mechanism 110 are provided, and preferably each include a table top 164. FIG. 3 illustrates loading from a first position from the first side S1, and FIG. 4 illustrates loading from the second side S2. If necessary, the staging means 160, 162 have different heights H1, H2 in order to enable a load-while-running operation during which a new roll 155, of media can be staged and loaded onto the media supply assembly 130, while the system is web feeding from a feed roll 154 of media thereon (FIG. 4). In other words, since each of the loading positions is 120° from the feeding roll or roll being fed, the system can be reloaded while feeding from the feeding roll, because the other rolls are not under power, and at least one of them will be aligned with a loading position.

The multi-roll media supporting and supply system 100 also includes a drive mechanism 170 that is coupled to the drive or support shaft 140 of the media supply assembly 130 for rotatably driving the media supply assembly 130 about the first axis 140 of rotation. Preferably, the drive mechanism 170 includes a motor 172 and a worm gear (not shown).

Figure 2:
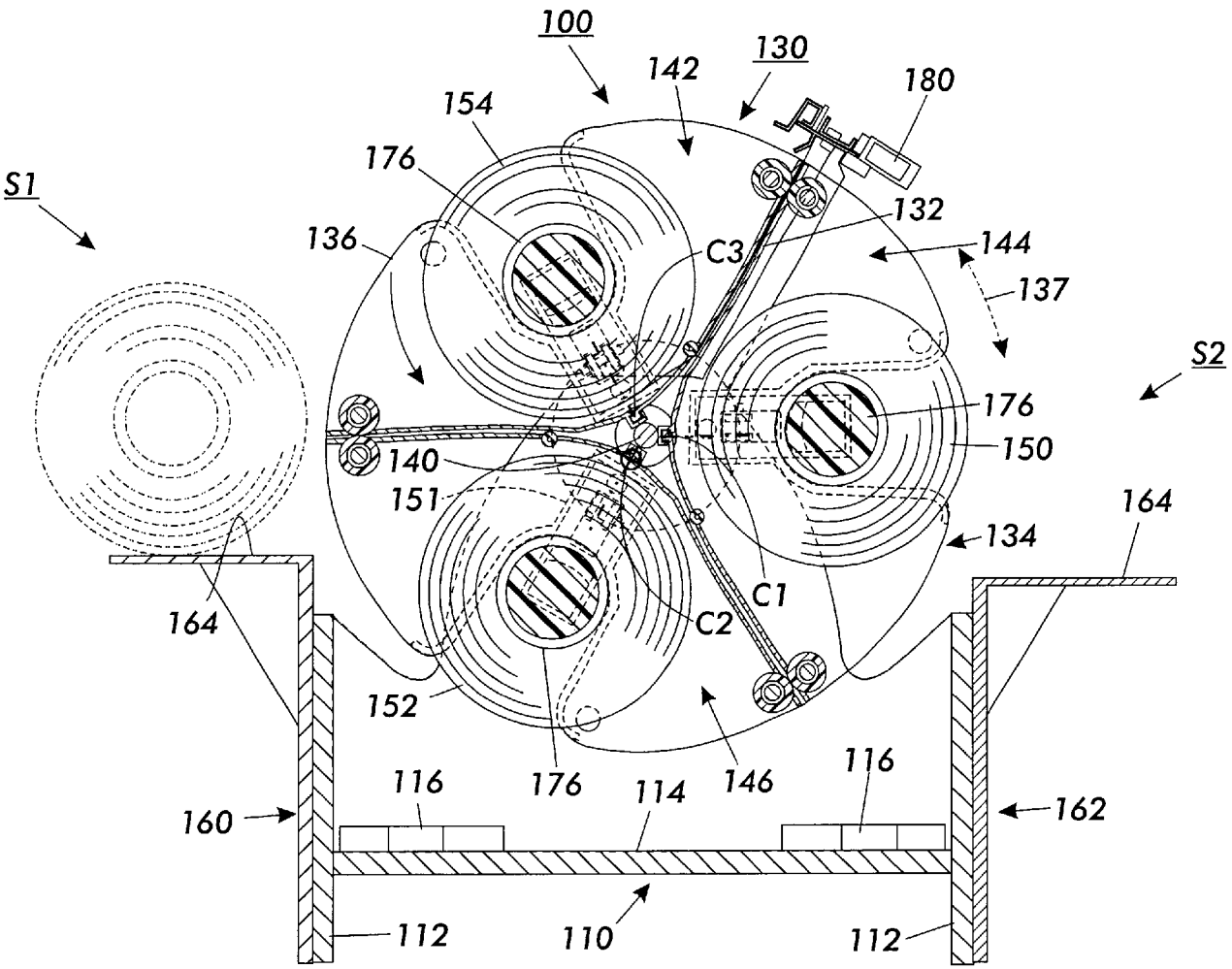
FIG. 2 is an enlarged schematic end view of the multi-roll media supporting and supply system of the present invention with a roll in a web feeding position.

As illustrated, each elongate recess 142, 144, 146 includes web feeding means 122 for safely feeding media or a web 132 of media from a roll 150, 152, 154 of media supported therein and at the feed position (FIGS. 1, 2 and 4). The web feeding means 122 in each recess include a web guide roller 124 and at least a web guide baffle 126 defining a web path 128 therein. The web feeding means 122 also include a pair of web metering rolls 147, 148 that form a media web driving and metering nip 149. Each pair of web metering rolls 147, 148 is mounted between pairs of the recesses 142, 144, 146, to the cylindrical member 134, and close to the periphery 136 of the cylindrical member 134, and hence of the recess.

The multi-roll media supporting and supply system 100 further includes a spindle member 176 in each elongate recess 142, 144, 146 for rotatably supporting a roll 150, 152, 154 of media within each such elongate recess. Each such spindle member 176 is removable from within their respective recess, and may include adjustable end clamps for enabling support of different lengths of rolls of media loaded thereon.

The multi-roll media supporting and supply system 100 as shown also includes a web cutting device 180 that is mounted externally, and immediately adjacent, to the periphery 136 of the cylindrical member 134 for cutting off media or a web 132 of media, feeding from the media supply assembly 130, thereby eliminating a need for, and hence downtime from, significant rewinding when switching feeding rolls. The cutter or cutting device 180 is stationary and pre-aligned with web forwarding rolls 182, 184 that forward the media web 132 to the transfer station 28 of machine 8. As such, the cutter 180 does not rotate with the media supply assembly 130. This makes it easier to align the web feeding means 122 of each recess to the web forwarding rolls 182,184.

Thus, as illustrated, a plural number (3) of rolls 150, 152, 154 of media 132, for a copier or printer machine 8, are arranged in a circular array on a cylindrical member 134. The cylindrical member 134 is rotatable bi-directionally (arrow 137) about the shaft or axis 140 in such a manner that any of the rolls 150, 152, 154 can be stopped at the feed position (FIGS. 1, 2 and 4), and fed to the machine 8, merely by rotating the cylindrical member 134 an appropriate number of degrees. Although the described embodiment has three rolls 150, 152, 154, the multi-roll supporting and supply system 100 can of course be designed to accommodate any required number of such rolls, depending on the allowable diameter and weight of the rolls and of the cylindrical member 134.

As mentioned above, some media roll using machines such as wide format copiers use three rolls of media, arranged conventionally in a vertical, or near vertical array. This results in a higher machine than desired, as well as in various lengths of media between the roll and the next stage of the process, usually a cutter. Consequently, there is a need to significantly rewind the media web from a feeding roll, if it is desired to remove it for any reason, or if it the end of a roll.

However, in accordance with the present invention, the multi-roll media supporting and supply system 100 minimizes the need for significant rewind by providing only a consistent, short length of web 132 from the feeding roll or roll being fed, to the cutter 180.

As illustrated, the system 100 is capable of supporting the plurality (three) of rolls 150, 152, 154 of media, on support spindle members 176. Each of the rolls 150, 152, 154 is supported rotatably within an elongate semi-circular recess 142, 144, 146 as shown. The elongate semi-circular recesses 142, 144, 146 are arranged symmetrically with their centers C1, C2, C3 at 120 degrees apart around the cylindrical member 134, and are each spaced an equal distance from the axis 140 of rotation. As such, in order to select a different feed roll of media, only a rotation of 120 degrees is required, particularly because the cylindrical member 134 can rotate either way (bi-directionally.

Therefore, when it is desired to feed a particular one of the rolls 150, 152, 154 of media, the cylindrical member 134 is rotated by its drive mechanism 170, to the feed position (FIGS. 1, 2 and 4). After a new roll is loaded and is about to be fed at the feed position, a relatively short web 132 of media such as paper, is freed from the roll, and threaded around the guide roller 124, and beneath the guide baffle 126 through its set of driven web metering rolls 147, 148 to the cutter 180. At the feed position (FIGS. 1, 2 and 4), the guide roller 124, guide baffle 126, and feed nip 149 of metering rolls 47, 48, are aligned with the cutter 180. Subsequent rewind of a feeding roll in order to switch to another roll, merely retracts the lead edge to the periphery 136, and thus it is not necessary to rethread this particular roll if it is again to be the feeding roll.

At the feed position (FIGS. 1, 2 and 4), the set of driven web metering rolls 147, 148 of the feed roll are aligned and synchronized with at least a driven pair of web forwarding nip forming rolls 182, 184 within the frame 12 of the machine 8. These sets of driven web metering rolls 147, 148 are mounted one set within each elongate recess 142, 144, 146 so that each roll 150, 152, 154 of media has a set thereof. Each set of driven web metering rolls 147, 148 is mounted near the periphery 136 of its elongate recess, and at an equal distance from the axis 140 of rotation. They are each thus being supported at an equal distance from the rolls 150, 152, 154 within the recesses 142, 144, 146, thereby ensuring that a web 132 of media from the roll 150, 152, 154 to these rolls 147, 148 will be consistently and relatively short.

Because these metering rolls 147, 148 in each recess 142, 144, 146 are mounted at the periphery 136 of the cylindrical member 134, a web 132 of media from the feed roll only has a short distance to feed before it is grasped by the cutter 180 and by the next set of driven rolls 182, 184 that forward the media web 132 to the transfer station 28 of machine 8. Thus, when it is desired to change feed rolls, and hence media selection, only a short length of media web 132 must be rewound in order to allow the cylindrical member 134 to rotate backwardly. This can also be accomplished without the feed roll rotating backwardly simply by creating a buckle of the web 132 between the metering rolls 147, 148 and the feed roll itself.

In addition, with any plural number of rolls in the cylinder, whether 3, 4 or 5, an operator can load a roll into an empty recess from either of the long sides S1, S2 (FIGS. 3 and 4) of the system 100, usually referred to as front or back of the machine. The cylindrical member 134 can be stopped at any position that is convenient for loading from either side. The staging means 160, 162 with a table top 164, are each mounted so as to provide a consistent and convenient position from which to load a new roll into an empty recess (FIGS. 3, 4) and with inward (arrow 139) and downward motion, without having to get down on the floor to load the bottom roll of a conventional machine. An interlocking mechanism (not shown) should be installed for preventing an operator from rotating the cylindrical member 134 when the operator's hands are in a possible pinch area between the cylindrical member 134 and any of the associated cabinetry.

Loading from both the front and rear of the system 100 provides an important advantage when a device such as a folder or large output or input paper tray may be attached to the machine or when the machine must be located where access to one or more sides is restricted. Also, since no drawers need to be opened to refill or change rolls of media, parts are saved and no floor space is required to allow room for the opened drawer and for the operator.

It should be noted that tubes can be used as suitable spindle members 176 to support the rolls 150, 152, 154 of media. This allows some simplification of the supporting of various width rolls of media, since the actual length of the piece which has to be attached to the machine is consistent. When different length rolls are to be run, the tube or spindle member is always the same length and merely projects further from the ends of the shorter or narrower rolls of media.

As can be seen, there has been provided a multi-roll media supporting and supply system for supporting and supplying a web of media from a roll of media to a media using machine. The multi-roll media supporting and supply system includes a support mechanism having a first side and a second side; a media supply assembly supported rotatably on the support mechanism, including a cylindrical member having a circular periphery, a drive or support shaft defining a first axis of rotation, and a plurality of elongate recesses, each for supporting a roll of media. The multi-roll media supporting and supply system also includes a staging assembly associated with at least one of the first side and the second side of the support mechanism for assisting loading of a roll of media onto the media supply assembly.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A multi-roll media supporting and supply system for supporting and supplying a web of media from a roll of media to a media using machine, the multi-roll media supporting and supply system comprising:

(a) a support mechanism having a first side and a second side;

(b) a media supply assembly supported rotatably on the support mechanism, the media supply assembly including a cylindrical member having a circular periphery, a shaft defining a first axis of rotation, and a plurality of elongate recesses for each supporting a roll of media; and (c) a pair of staging means one for each of said first side and said second side of said support mechanism for staging a roll of media before loading onto said media supply assembly, said pair of staging means having different heights for enabling a load-while-running operation during which a new roll of media can be staged and loaded onto said media supply assembly while web feeding from another roll of media thereon to the media using machine.

2. The multi-roll media supporting and supply system of claim 1, wherein the support mechanism includes a set of legs, and cross members for holding electronic control components for the multi-roll media supporting and supply system.

3. The multi-roll media supporting and supply system of claim 1, wherein the media supply assembly is supported rotatably on the support mechanism.

4. The multi-roll media supporting and supply system of claim 1, including a drive mechanism coupled to the shaft of the media supply assembly for rotatably driving the media supply assembly about the first axis of rotation.

5. The multi-roll media supporting and supply system of claim 1, wherein each elongate recess of the plurality of elongate recesses includes web feeding means for safely feeding a web of media from a roll of media supported within the each elongate recess.

6. The multi-roll media supporting and supply system of claim 1, wherein each elongate recess of the plurality of elongate recesses has the same depth from the periphery towards the axis of rotation of the cylindrical member.

7. The multi-roll media supporting and supply system of claim 1, wherein the plurality of elongate recess comprises three elongate recesses.

8. The multi-roll media supporting and supply system of claim 1, including a web cutting device mounted externally, and immediately adjacent, to the periphery of the cylindrical member for cutting off a web of media feeding from the media supply assembly, thereby eliminating a need for, and hence downtime from, significant rewinding when switching feeding rolls.

9. The multi-roll media supporting and supply system of claim 1, wherein each of the staging means includes a table top.

10. The multi-roll media supporting and supply system of claim 3, wherein the media supply assembly is supported for bi-directional rotation on the support mechanism about the first axis of rotation.

11. The multi-roll media supporting and supply system of claim 4, wherein the drive mechanism includes a motor and a worm gear.

12. The multi-roll media supporting and supply system of claim 5, wherein the web feeding means include a web guide roller and at least a web guide baffle defining a web path within the each elongate recess.

13. The multi-roll media supporting and supply system of claim 5, wherein the web feeding means include a pair of web metering rolls forming a media web driving and metering nip.

14. The multi-roll media supporting and supply system of claim 5, including a mandrel in each elongate recess for rotatably supporting a roll of media within the each elongate recess.

15. The multi-roll media supporting and supply system of claim 7, wherein the three elongate recesses are arranged in a circular array, and each elongate recess having a centers spaced 120° from that of an adjacent elongate recess.

16. The multi-roll media supporting and supply system of claim 13, wherein each pair of the pair of web metering rolls is mounted to the cylindrical member, close to the periphery thereof.

17. The multi-roll media supporting and supply system of claim 13, including a spindle member in each elongate recess, and each spindle member is removable from within each said elongate recess.

* * * * *